US010474054B2

(12) United States Patent
Portnoy et al.

(10) Patent No.: US 10,474,054 B2
(45) Date of Patent: Nov. 12, 2019

(54) ADJUSTMENTS TO PRINT BLANKET BIAS VOLTAGES

(71) Applicant: HP INDIGO B.V., Amstelveen (NL)

(72) Inventors: Vitaly Portnoy, Ness Ziona (IL); Michel Assenheimer, Ness Ziona (IL); Amiran Lavon, Ness Ziona (IL); Ido Finkelman, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 15/320,391

(22) PCT Filed: Jun. 30, 2014

(86) PCT No.: PCT/EP2014/063878
§ 371 (c)(1),
(2) Date: Dec. 20, 2016

(87) PCT Pub. No.: WO2016/000747
PCT Pub. Date: Jan. 7, 2016

(65) Prior Publication Data
US 2017/0160666 A1 Jun. 8, 2017

(51) Int. Cl.
*G03G 15/00* (2006.01)
*G03G 15/02* (2006.01)
*G03G 15/16* (2006.01)

(52) U.S. Cl.
CPC ..... *G03G 15/0266* (2013.01); *G03G 15/0275* (2013.01); *G03G 15/0283* (2013.01); *G03G 15/1605* (2013.01); *G03G 15/1645* (2013.01); *G03G 2215/0112* (2013.01)

(58) Field of Classification Search
CPC ..... G03G 15/266
USPC ..... 399/66
See application file for complete search history.

(56) References Cited

U.S. PATENT DOCUMENTS 4,218,972 A * 8/1980 Fujishiro ..... B41F 13/28 101/177
5,066,988 A 11/1991 Miyake
5,272,975 A * 12/1993 Dettinger ..... B41F 13/40 101/218
5,649,482 A * 7/1997 Hummel ..... B41F 13/28 101/218
6,148,159 A 11/2000 Shiraishi
6,192,205 B1 2/2001 Motohashi
7,400,850 B2 * 7/2008 Romem ..... G03G 15/161 399/296

(Continued)

FOREIGN PATENT DOCUMENTS

JP H04181954 6/1992
JP 2004093770 3/2004
WO WO-2007050085 5/2007

OTHER PUBLICATIONS

Kim, K., Effects of Blanket Roller Deformation on Printing Qualities in Gravure-offset Printing Method, May 20, 2010. http://iopscience.iop.org/article/10.1143/JJAP.49.05EC04/meta;jsessionid=156D58E3BB5A44876FDCD1DA127D1A5C.c2.iopscience.cld.iop.org.

*Primary Examiner* — Quana Grainger
(74) *Attorney, Agent, or Firm* — HP Inc. Patent Department

(57) ABSTRACT

In an example, a method of controlling voltage applied to a print blanket within a printing device includes printing a print job. During the printing, a null cycle trigger is received. In response to the trigger, a print blanket bias voltage is reduced from a print bias level to a null bias level.

15 Claims, 3 Drawing Sheets

(56) References Cited

U.S. PATENT DOCUMENTS

| | | | | |
|---|---|---|---|---|
| 2004/0253012 | A1* | 12/2004 | Ishibashi | G03G 15/50 399/49 |
| 2005/0281570 | A1* | 12/2005 | Takeuchi | G03G 15/166 399/49 |
| 2008/0181680 | A1* | 7/2008 | Peleg | G03G 15/0131 399/302 |
| 2009/0238592 | A1* | 9/2009 | Yacoub | G03G 15/1625 399/66 |
| 2011/0158712 | A1* | 6/2011 | Yacoub | G03G 15/0131 399/302 |

* cited by examiner

ADJUSTMENTS TO PRINT BLANKET BIAS VOLTAGES

CROSS-REFERENCE TO RELATED APPLICATION

This application is a U.S. National Stage Application of and claims priority to International Patent Application No. PCT/EP2014/063878, filed on Jun. 30, 2014, and entitled "PRINT BLANKET BIAS VOLTAGE," which is hereby incorporated by reference in its entirety.

BACKGROUND

Electro-photography (EP) printing devices form images on print media by placing a uniform electrostatic charge on a photoreceptor and then selectively discharging the photoreceptor in correspondence with the images. The selective discharging forms a latent image on the photoreceptor. Colorant is then developed onto the latent image of the photoreceptor, and the colorant is ultimately transferred to the media to form the image on the media. In dry EP (DEP) printing devices, toner is used as the colorant, and it is received by the media as the media passes below the photoreceptor. The toner is then fixed in place as it passes through heated pressure rollers. In liquid EP (LEP) printing devices, ink is used as the colorant instead of toner. In LEP devices, an ink image developed on the photoreceptor is offset to an image transfer element, where it is heated until the solvent evaporates and the resinous colorants melt. This image layer is then transferred to the surface of the media in the form of an image or text.

The transfer of the ink image from the photoreceptor to the image transfer element is driven by a nip contact and an electric field created by a bias voltage applied to the transfer element.

BRIEF DESCRIPTION OF THE DRAWINGS

The present embodiments will now be described, by way of example, with reference to the accompanying drawings, in which.

Throughout the drawings, identical reference numbers designate similar, but not necessarily identical, elements.

DETAILED DESCRIPTION

Figure 1:
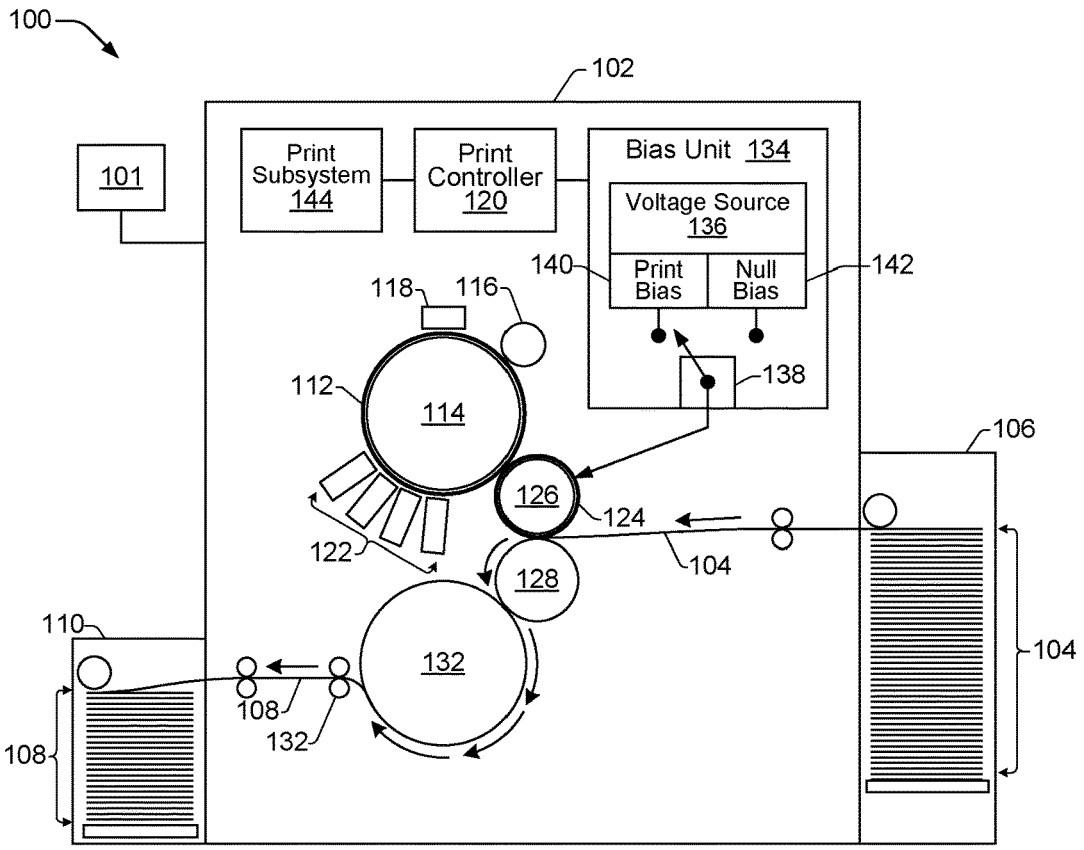
FIG. 1 shows an example of a printing device suitable for detecting the onset of a null cycle and for making a proactive adjustment to the bias voltage of a print blanket during the null cycle.

The following description provides illustrative examples of an apparatus and printing process associated with an LEP printing process. However, the examples are presented for the purpose of illustration rather than limitation, and they may therefore be applicable to printing processes other than the LEP printing process described below. An LEP printing device implemented as a digital offset press uses electrically charged ink with a thermal offset print blanket. In an LEP printing press, the surface of a photo imaging component is uniformly charged and then selectively discharged to form a latent image. The photo imaging component is often referred to as a "photoconductor" or a "photoreceptor", and it will be referred to as such for the remainder of this description. The latent image is formed on the photoreceptor using photo-induced electric conductivity and a laser beam that discharges the electro-statically charged photoreceptor in a pattern consistent with the image. Charged liquid ink is then applied to the surface of the photoreceptor, forming an ink image. The charged ink is attracted to locations on the photoreceptor where surface charge has been neutralized by the laser, and repelled from locations on the photoreceptor where surface charge has not been neutralized by the laser.

The ink image is then transferred from the surface of the photoreceptor to an intermediate transfer media (ITM), referred to herein as the "blanket", or "print blanket". Transferring the ink image from the photoreceptor to the print blanket is often referred to as the "first transfer". Transfer of the ink image from the photoreceptor to the print blanket in the first transfer is driven by rolling nip contact forces (i.e., between the photoreceptor and the blanket) and electrophoresis of the electrically charged ink particles. The electric field between the photoreceptor and print blanket that drives the ink transfer is created by a bias voltage applied to the print blanket. The bias voltage applied to the print blanket may be referred to herein variously as the bias voltage, blanket bias voltage, print blanket bias voltage, ITM bias voltage, or other similar variations. In addition to having a bias voltage applied to it, the blanket is heated and maintained at a high temperature in order to evaporate solvents present in the liquid ink and to partially melt and blend solid ink particles. The high blanket temperature, along with contact pressure between the blanket and an impression drum, facilitate a "second transfer" of the image onto the print media. In the second transfer, the ink image is transferred from the print blanket to the print media (e.g., sheet paper, web paper) by pressing the blanket against the print media which is being held on the impression drum.

Throughout the printing process, the print blanket encounters a number of wear mechanisms that cause damage to the blanket. Damage to the print blanket eventually has a negative impact on the quality of the printed output. Therefore, such wear mechanisms effectively shorten the useful lifespan of the blanket, since printing press operators typically replace print blankets when the print quality begins to suffer. Unfortunately, replacing print blankets is expensive and reduces printer output efficiency because of the time involved in the replacement process.

One common blanket wear mechanism is referred to as blanket memory. Blanket memory can cause damage to a blanket through the continual placement of the same or similar images in the same position on the blanket. As the number of these printed images increases, the blanket wear increases and eventually appears as a defect on other printed images. Another blanket wear mechanism is the repeated pressing of the print media against the blanket, which causes the sharp edges of the media to cut into the blanket. Cut-marks that develop in the blanket can result in a poor transfer of ink within the cut-marks to the print media when subsequently printing larger images that extend beyond the cut-marks. The cut-marks can eventually become visible defects on the printed output.

Yet another blanket wear mechanism is the effect of the high bias voltage applied to the print blanket. During normal printing, in the first transfer that transfers the ink image from the photoreceptor to the print blanket, current flow results from the electrical potential between the photoreceptor and the blanket. However, during a non-productive null cycle, as discussed below, no potential is needed between the photoreceptor and the blanket. The high bias voltage during normal printing can cause a corona breakdown and the formation of plasma between the blanket and photoreceptor that is damaging to the blanket top layer, referred to as the blanket release layer. Ozone is created by corona breakdown, and the impact of the ozone on the print blanket can also cause damage to the blanket release layer. Corona is fundamentally a breakdown phenomenon that follows Paschen's law. It has been determined that a minimum blanket bias voltage employed to achieve an acceptable image transfer from the photoreceptor to the blanket is higher than a threshold value for causing a corona breakdown through the air between the blanket and photoreceptor. In a corona breakdown, the neutral air between dielectric materials such as the photoreceptor and the blanket becomes ionized, resulting in a region of plasma through which current flows between the photoreceptor and the blanket. By way of example, the threshold corona breakdown voltage, or Paschen voltage, may be on the order of about 450V between the photoreceptor and the blanket. However, the minimum blanket bias voltage to achieve an acceptable image transfer may be 500V or higher. Therefore, a challenge remains in the printing process regarding how to achieve an acceptable image transfer from the photoreceptor to the print blanket at a blanket bias voltage of 500V or higher, for example, while minimizing the damaging effects of plasma from the unavoidable corona breakdown which can occur, for example at a threshold breakdown voltage of 450V.

Furthermore, during a null cycle when normal printing is briefly suspended, these damaging effects on the blanket can be exacerbated. A null cycle is a non-productive cycle that occurs within the press due to an interrupt from a printing subsystem. During a null cycle, no potential is needed between the photoreceptor and the blanket. As an image in the current print cycle is transferred from the blanket to the print media during normal printing, instead of beginning a new print cycle, an interrupt can cause a null cycle to be inserted between print cycles. A null cycle can be triggered by various printing subsystems as a way to inform the print controller within the press that a subsystem is not ready to continue with normal printing. For example, during normal printing, a sensor in the print media transport system may detect that the print media has not arrived at a particular location along the media transport path by a designated instant in time. The detection by the media transport system of such a media timing issue can serve as an interrupt to the print controller within the press that triggers a null cycle. For each subsequent print cycle during which the interrupt from the media transport system persists, an additional null cycle will be inserted to continue suspending the normal printing process. In another example, while performing a color calibration, the printing press can insert null cycles into the printing process while it waits for an inline densitometer/spectrophotometer to measure a printed page before it prints a next page.

During a null cycle, the printing press operates as if normal printing is being performed, but there is actually no image development or image transfer taking place. During the null cycle, most of the printing components remain operational so that when the next print cycle begins, these components are ready to resume writing and transferring images as normal. For example, in a null cycle, the photoreceptor drum, ITM drum, and the image impression drum will continue to spin. In addition, the bias voltage being applied to the print blanket during a null cycle also remains at a high bias level in anticipation of an upcoming printing cycle. However, during the null cycle there is no development of an image onto the photoreceptor and no transfer of an image from the photoreceptor to the blanket on the ITM drum. Thus, the "first transfer" of an ink image from the photoreceptor to the print blanket does not occur during a null cycle. Because there is no transfer of an ink image to the print blanket during the null cycle, the blanket will be dryer during the null cycle than it is during a normal printing cycle because the blanket will be devoid of any ink, ink solvents, or other liquid carrier that typically coat the blanket during a printing cycle. Unfortunately, the dry print blanket tends to increase the current flow and the plasma formation between the photoreceptor and the blanket, which in turn causes additional damage to the blanket. As a result, the damaging effect of the high blanket bias voltage noted above, is increased during null cycles.

Accordingly, example systems and methods described herein detect the onset of a null cycle and make an adjustment to the bias voltage being applied to the print blanket during the null cycle. The adjustment of the bias voltage reduces the voltage applied to the blanket in order to help minimize or avoid the negative effects of an increase in current and plasma formation between the photoreceptor and the blanket that may otherwise occur during the null cycle while the blanket is dry. When a null cycle is triggered, the bias voltage is selected to be below the Paschen voltage or threshold corona breakdown voltage, which prevents plasma current between the photoreceptor and print blanket, and thereby avoids damage to the blanket. The bias voltage is also selected to be positive with respect to the photoreceptor. The minimum blanket bias voltage is higher than a V-light value, which refers to the residual voltage remaining on the photoreceptor after being discharged by light. The V-light value increases as the photoreceptor ages, and it typically varies from around 10-20V for a new photoreceptor to an acceptable limit on the order of 180V. Therefore, the bias voltage applied to the blanket when a null cycle is detected is typically the lowest value possible that is below the Paschen voltage but still above V-light.

In one example, a method of controlling voltage applied to a print blanket within a printing device, includes printing a print job. During printing of the print job, a null cycle trigger is received. In response to the null cycle trigger, the bias voltage being applied to a print blanket is reduced from a print bias level to a null bias level. In another example, a non-transitory machine-readable storage medium stores instructions that when executed by a processor of a printing device, cause the printing device to detect an interrupt from a printing subsystem during a print cycle of a printing process. In response to detecting the interrupt, the printing device changes a print blanket bias voltage from a print bias level to a null bias level, and inserts a first null cycle into the printing process following the print cycle. The printing device further inserts an additional null cycle following the first null cycle for each null cycle in which the detection of the interrupt persists, and maintains the print blanket bias voltage at the null bias level during each null cycle. In another example, a printing device includes a print blanket to receive an ink image from a photoreceptor. The printing device further includes a bias unit to set a bias voltage of the print blanket, and a voltage source to provide a print bias voltage and a null cycle bias voltage. The printing device also includes a controller to receive a null cycle trigger, and to adjust a set-point of the bias unit from the print bias voltage to the null cycle voltage in response to the trigger.

FIG. 1 illustrates an example of a printing device 100 suitable for detecting the onset of a null cycle and for making a proactive adjustment to the bias voltage of a print blanket during the null cycle. The adjustment to the blanket bias voltage helps to minimize or avoid the negative effects of an increase in current and plasma formation between the print blanket and a photoreceptor that occurs in part because of the blanket being dry during the null cycle. The printing device 100 comprises a print-on-demand device, implemented as a liquid electro-photography (LEP) printing press 100. An LEP printing press 100 generally includes a user interface 101 that enables the press operator to manage various aspects of printing, such as loading and reviewing print jobs, proofing and color matching print jobs, reviewing the order of the print jobs, and so on. The user interface 101 typically includes a touch-sensitive display screen that allows the operator to interact with information on the screen, make entries on the screen, and generally control the press 100. The user interface 101 may also include other devices such as a key pad, a keyboard, a mouse, and a joystick, for example.

An LEP printing press 100 includes a print engine 102 that receives a print substrate, illustrated as print media 104 (e.g., cut-sheet paper or a paper web) from a media input mechanism 106. After the printing process is complete, the print engine 102 outputs the printed media 108 to a media output mechanism, such as a media stacker tray 110. The printing process is generally controlled by a print controller 120 to generate the printed media 108 using digital image data that represents words, pages, text, and images that can be created, for example, using electronic layout and/or desktop publishing programs. Digital image data is generally formatted as one or multiple print jobs that are stored and executed on the print controller 120, as further discussed below with reference to FIG. 2.

The print engine 102 includes a photo imaging component, such as a photoreceptor 112 mounted on an imaging drum 114 or imaging cylinder 114. The photoreceptor 112 defines an outer surface of the imaging drum 114 on which images can be formed. A charging component such as charge roller 116 generates electrical charge that flows toward the photoreceptor surface and covers it with a uniform electrostatic charge. The print controller 120 uses digital image print data and other inputs such as print job and print media parameters, temperatures, and so on, to control a laser imaging unit 118 to selectively expose the photoreceptor 112. The laser imaging unit 118 exposes image areas on the photoreceptor 112 by dissipating (neutralizing) the charge in those areas. Exposure of the photoreceptor in this manner creates a 'latent image' in the form of an invisible electrostatic charge pattern that replicates the image to be printed.

After the latent/electrostatic image is formed on the photoreceptor 112, the image is developed by a binary ink development (BID) roller 122 to form an ink image on the outer surface of the photoreceptor 112. Each BID roller 122 develops one ink color of the image, and each developed color corresponds with one image impression. While four BID rollers 122 are shown, indicating a four color process (i.e., a CMYK process), other press implementations may include additional BID rollers 122 corresponding to additional colors. In addition, although not illustrated, print engine 102 also includes an erase mechanism and a cleaning mechanism which are generally incorporated as part of any electrophotographic process.

In a first image transfer, the single color separation impression of the ink image developed on the photoreceptor 112 is transferred from the photoreceptor 112 to an image transfer blanket 124. The image transfer blanket 124 is primarily referred to herein as the print blanket 124 or blanket 124. The print blanket 124 overlies and is securely fastened to the outer surface of the intermediate transfer media (ITM) drum 126, sometimes referred to as the image transfer drum 126. The first image transfer that transfers ink from the photoreceptor 112 to the print blanket 124 is driven by electrophoresis of the electrically charged ink particles and an applied mechanical pressure between the imaging drum 114 and the ITM drum 126. The blanket 124 is electrically conductive, enabling it to be electrified by an applied bias voltage, referred to variously herein as the bias voltage, blanket bias voltage, print blanket bias voltage, ITM bias voltage, and other similar variations. The electric field that drives the ink transfer is created by the applied bias voltage. Both the blanket bias voltage and the mechanical pressure between the imaging and ITM drums can have a significant impact on image transfer quality.

The print blanket 124 is heated by both internal and external heating sources such as infrared heating lamps (not shown). Heat from the heated print blanket 124 causes most of the carrier liquid and solvents in the transferred ink image to evaporate. The blanket heat also causes the particles in the ink to partially melt and blend together. This results in a finished ink image on the blanket 124 in the form of a hot, nearly dry, tacky plastic ink film. In a second image transfer, this hot ink film image impression is then transferred to a substrate such as a sheet of print media 104, which is held by an impression drum/cylinder 128. The temperature of the print media substrate 104 is below the melting temperature of the ink particles, and as the ink film comes into contact with the print media substrate 104, the ink film solidifies, sticks to the substrate, and completely peels off from the blanket 124.

This process is repeated for each color separation in the image, and the print media 104 remains on the impression drum 128 until all the color separation impressions (e.g., C, M, Y, and K) in the image are transferred to the print media 104. After all the color impressions have been transferred to the sheet of print media 104, the printed media 108 sheet is transported by various rollers 132 from the impression drum 128 to the output mechanism 110.

As mentioned above, in the first image transfer, the electric field that drives the ink transfer from the photoreceptor 112 to the print blanket 124 is created by a bias voltage applied to the blanket 124. Thus, as shown in FIG. 1, the LEP printing press 100 also includes a bias unit 134. The bias unit 134 can include a voltage source 136 that it controls in order to apply a bias voltage to the print blanket 124. The bias unit 134 can control the voltage source 136 through directions received from the print controller 120. For example, the print controller 120 can direct the bias unit 134 to adjust a bias voltage being applied to the print blanket 124 between various bias voltage values. The bias voltage can be applied or transferred to the blanket 124, for example, using slip rings that enable a stationary power supply within the press to electrify the rotating blanket 124. In some examples, the bias unit 134 can be directed to adjust the blanket bias voltage by changing a bias voltage set-point 138 between a print cycle bias voltage 140 and a null cycle bias voltage 142 provided by the voltage source 136. In some examples, the print cycle bias voltage 140 is on the order of 500V or greater, and the null cycle bias voltage 142 is a value below the Paschen voltage or threshold corona breakdown voltage, but above a V-light voltage (i.e., the residual voltage remaining on the photoreceptor after being discharged by light). In some examples, the V-light voltage value used can be a preset maximum allowable value of approximately 180V. In other examples, the V-light voltage used can be an actual measured value of the residual voltage remaining on the photoreceptor which enables the null cycle bias voltage 142 to be dynamically set based on the measured V-light.

Figure 2:
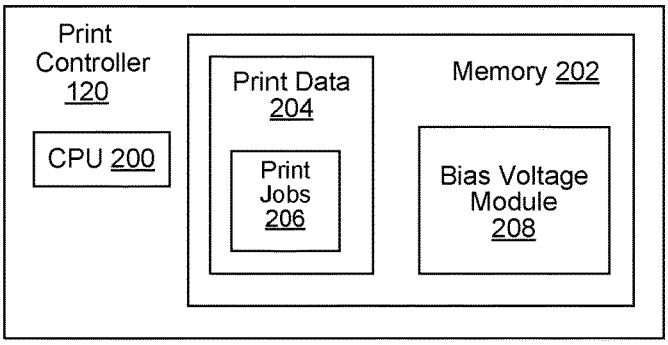
FIG. 2 shows a box diagram of an example print controller suitable for implementing within an LEP printing press to control a printing process and to make adjustments to the bias voltage applied to a print blanket upon detecting a null cycle trigger.

FIG. 2 shows a box diagram of an example print controller 120 suitable for implementing within an LEP printing press 100 to control a printing process and to make adjustments to the bias voltage applied to a print blanket upon detecting a null cycle trigger. Referring to FIGS. 1 and 2, print controller 120 generally comprises a processor (CPU) 200 and a memory 202, and may additionally include firmware and other electronics for communicating with and controlling the other components of print engine 102, the user interface 101, and media input (106) and output (110) mechanisms. Memory 202 can include both volatile (i.e., RAM) and nonvolatile (e.g., ROM, hard disk, optical disc, CD-ROM, magnetic tape, flash memory, etc.) memory components. The components of memory 202 comprise non-transitory, machine-readable (e.g., computer/processor-readable) media that provide for the storage of machine-readable coded program instructions, data structures, program instruction modules, JDF (job definition format), and other data for the printing press 100, such as module 208. The program instructions, data structures, and modules stored in memory 202 may be part of an installation package that can be executed by processor 200 to implement various examples, such as examples discussed herein. Thus, memory 202 may be a portable medium such as a CD, DVD, or flash drive, or a memory maintained by a server from which the installation package can be downloaded and installed. In another example, the program instructions, data structures, and modules stored in memory 202 may be part of an application or applications already installed, in which case memory 202 may include integrated memory such as a hard drive.

As noted above, print controller 120 uses digital image data and other inputs to control the laser imaging unit 118 in the print engine 102 to selectively expose the photoreceptor 112. More specifically, controller 120 receives digital print data 204 from a host system, such as a computer, and stores the data 204 in memory 202. Data 204 represents, for example, documents or image files to be printed. As such, data 204 forms one or more print jobs 206 for printing press 100 that each include print job commands and/or command parameters. Using a print job 206 from data 204, print controller 120 controls components of print engine 102 (e.g., laser imaging unit 118) to form characters, symbols, and/or other graphics or images on print media 104 through a printing process as has been generally described above with reference to FIG. 1.

As previously mentioned, normal printing can be suspended in the press 100 upon the print controller 120 receiving or detecting a null cycle trigger. A null cycle trigger can comprise an interrupt generated by a printing subsystem 144, such as a color calibration subsystem or media transport subsystem. Such subsystem interrupts provide an error indication to the print controller 120 that the subsystem is not ready to continue normal printing. A bias voltage module 208 comprises program instructions stored in memory 202 and executable on processor 200 to cause the print controller 120, and/or printing press 100, to receive or detect a subsystem interrupt and to initiate various actions in response to the interrupt. For example, the controller 120 can use the interrupt as a trigger to insert a null cycle into the printing process, and to change the bias voltage applied to the print blanket 124 to help reduce damage to the print blanket during the null cycle. Changing the bias voltage can include providing a control signal to the bias unit 134 to change a bias set-point 138 from a print bias voltage 140 to a null cycle voltage 142. Instructions in module 208 can further cause the controller 120 to continually insert null cycles into the printing process until the controller 120 detects that the subsystem interrupt has terminated or is no longer present. In some examples, when enough consecutive null cycles are inserted, the controller 120 can eventually cause the press to "time-out" and put the press into a standby mode in which, for example, the drums stop rotating and certain printing subsystems enter an off or "sleep"-like state. As noted above, during a null cycle, the printing press 100 operates as if normal printing is being performed, but there is actually no image development or image transfer taking place. Therefore, most of the printing components remain operational (e.g., drums 114, 126, 128, remain spinning) so that when the next print cycle begins, these components are ready to resume writing and transferring images as normal. The controller 120 can maintain the blanket bias voltage at the null cycle voltage 142 during all the null cycles. When the controller 120 detects that the subsystem interrupt is no longer present, the controller 120 can change the bias voltage applied to the print blanket 124 back the print bias voltage level 140 and resume normal printing in the press 100 by inserting print cycles into the printing process.

Figure 3:
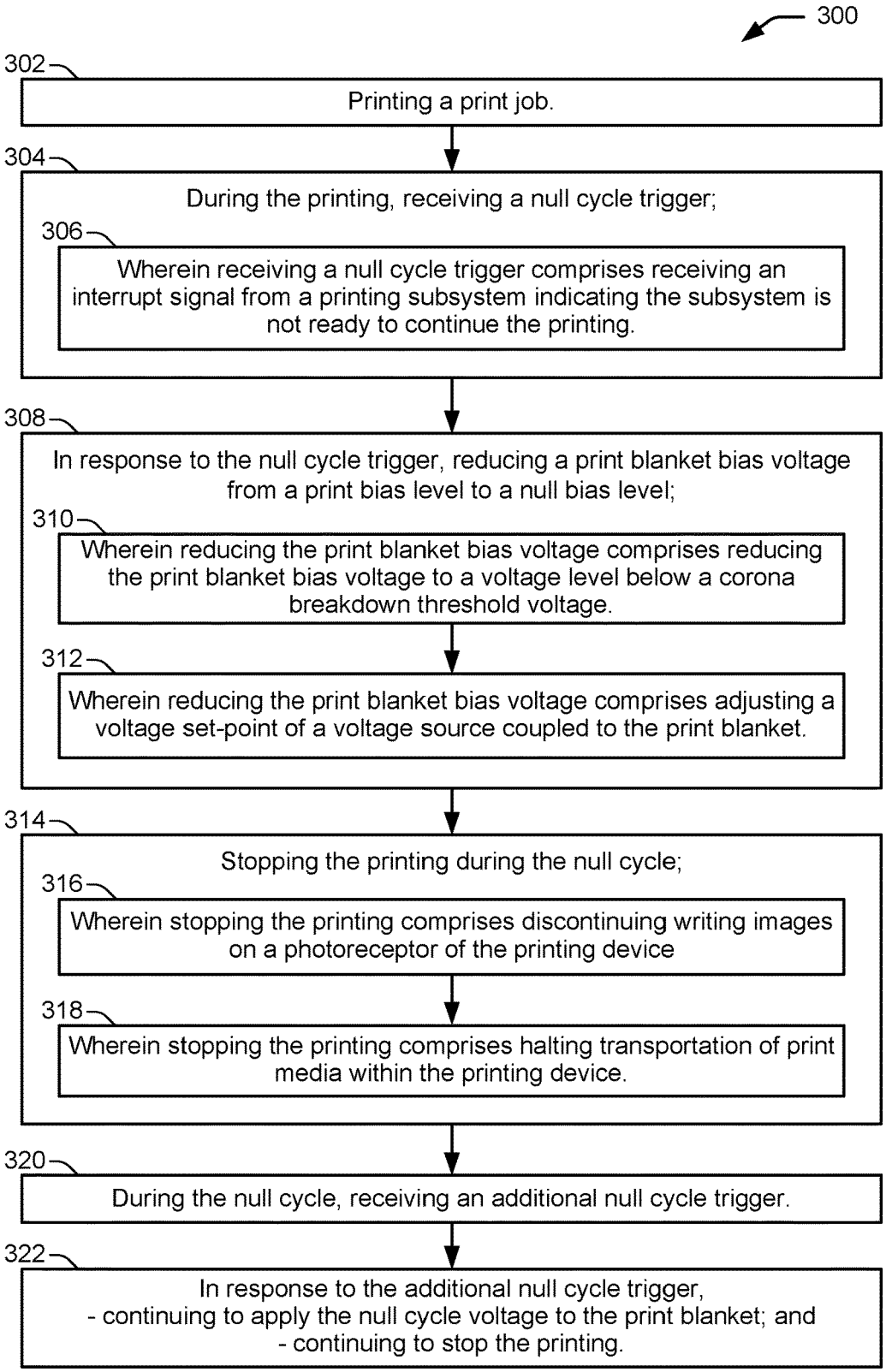
FIGS. 3 and 4 show flowcharts of example methods related to controlling voltage applied to a print blanket within a printing device.
Figure 4:
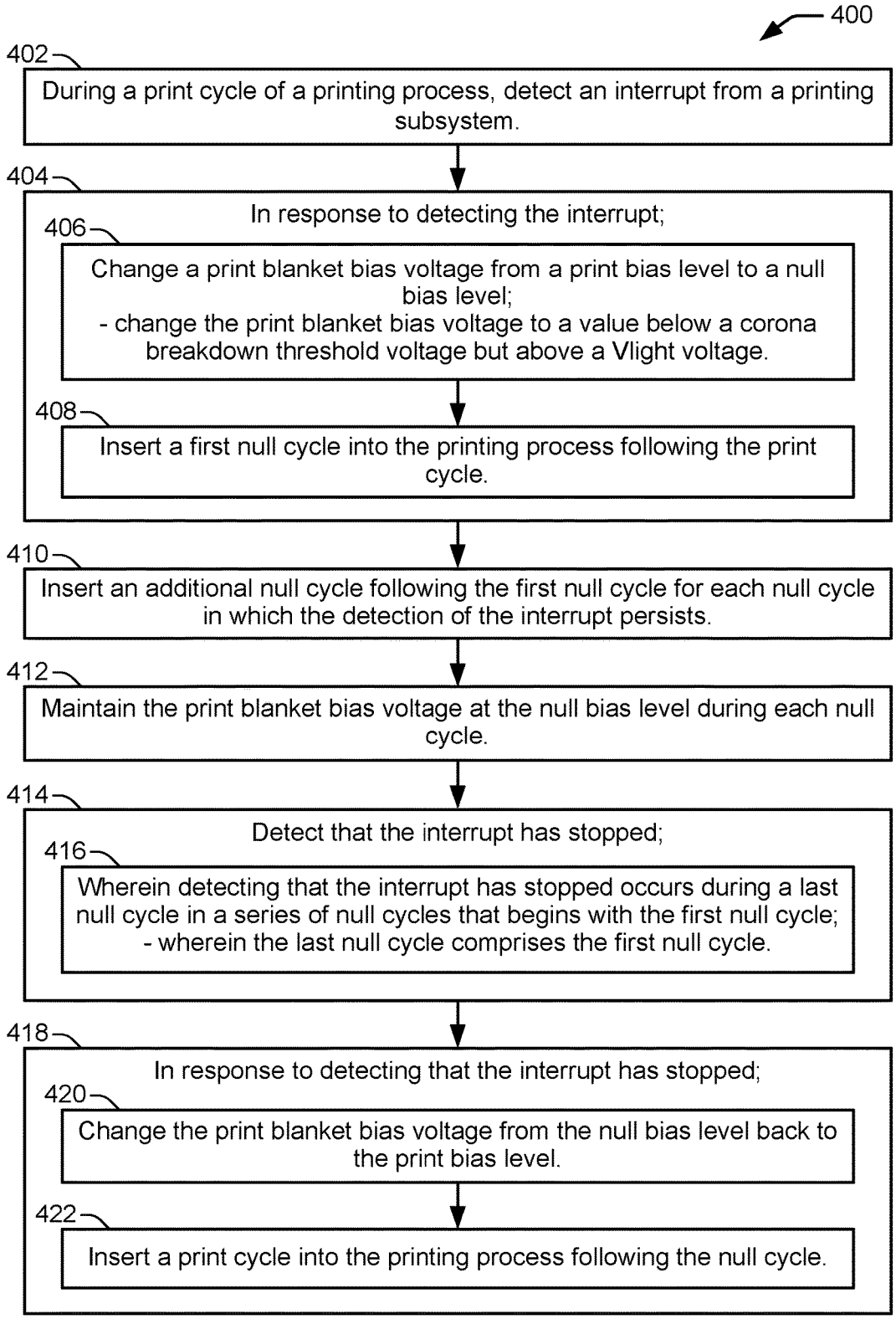

FIGS. 3 and 4 show flow diagrams that illustrate example methods 300 and 400, related to controlling printing in an LEP printing press 100 and to making adjustments to a bias voltage applied to a print blanket upon detecting a null cycle trigger. Methods 300 and 400 are associated with the examples discussed above with regard to FIGS. 1 and 2, and details of the operations shown in methods 300 and 400 can be found in the related discussion of such examples. The operations of methods 300 and 400 may be embodied as programming instructions stored on a non-transitory, machine-readable (e.g., computer/processor-readable) medium, such as memory 202 of printing press 100 as shown in FIGS. 1 and 2. In some examples, implementing the operations of methods 300 and 400 can be achieved by a processor, such as processor 200 of FIG. 2, reading and executing the programming instructions stored in memory 202. In some examples, implementing the operations of methods 300 and 400 can be achieved using an ASIC (application specific integrated circuit) and/or other hardware components alone or in combination with programming instructions executable by processor 200.

Methods 300 and 400 may include more than one implementation, and different implementations of methods 300 and 400 may not employ every operation presented in the respective flow diagrams. Therefore, while the operations of methods 300 and 400 are presented in a particular order within the flow diagrams, the order of their presentation is not intended to be a limitation as to the order in which the operations may actually be implemented, or as to whether all of the operations may be implemented. For example, one implementation of method 300 might be achieved through the performance of a number of initial operations, without performing one or more subsequent operations, while another implementation of method 300 might be achieved through the performance of all of the operations.

Referring now to the flow diagram of FIG. 3, an example method 300 of controlling voltage applied to a print blanket within a printing device such as press 100 begins at block 302, with printing a print job. During the printing, a null cycle trigger is received, as shown at block 304. Receiving a null cycle trigger can include receiving an interrupt signal from a printing subsystem indicating the subsystem is not ready to continue the printing, as shown at block 306. The method 300 continues at block 306 with reducing a print blanket bias voltage in response to the null cycle trigger. The bias voltage can be reduced from a print bias level to a null bias level. In some examples, reducing the print blanket bias voltage comprises reducing the print blanket bias voltage to a voltage level below a corona breakdown threshold voltage as shown at block 310. Reducing the print blanket bias voltage can also include adjusting a voltage set-point of a voltage source coupled to the print blanket as shown at block 312. The method 300 can also include stopping the printing during the null cycle, as shown at block 314. Stopping the printing may comprise discontinuing writing images on a photoreceptor of the printing device and halting transportation of print media within the printing device, as shown at blocks 316 and 318, respectively. Method 300 continues with receiving an additional null cycle trigger during the null cycle, and in response to the additional null cycle trigger, continuing to apply the null cycle voltage to the print blanket and stop the printing, as shown at blocks 320 and 322, respectively.

Referring now to the flow diagram of FIG. 4, an example method 400 related to controlling voltage applied to a print blanket within a printing device such as press 100 begins at block 402, with detecting an interrupt from a printing subsystem during a print cycle of a printing process. In response to the interrupt (block 404), a print blanket bias voltage is changed from a print bias level to a null bias level, as shown at block 406. Changing the print blanket bias voltage can include changing the print blanket bias voltage to a value below a corona breakdown threshold voltage but above a V-light voltage. Further in response to the interrupt, at block 408, a first null cycle can be inserted into the printing process following the print cycle. As shown at block 410 of method 400, for each null cycle in which the detection of the interrupt persists, an additional null cycle can be inserted following the first null cycle. Furthermore, as shown at block 412, during each null cycle, the print blanket bias voltage can be maintained at the null bias level. Method 400 can continue as shown at block 414, with detecting that the interrupt has stopped. As shown at block 416, detecting that the interrupt has stopped can occur during a last null cycle in a series of null cycles that begins with the first null cycle. In some examples, the last null cycle comprises the first null cycle. In response to detecting that the interrupt has stopped (block 418), the print blanket bias voltage can be changed from the null bias level back to the print bias level as shown at block 420. Further in response to detecting that the interrupt has stopped, a print cycle can be inserted into the printing process following the null cycle in order to begin normal printing from the press.

What is claimed is:

1. A method of controlling voltage applied to a print blanket within a printing device, comprising:

printing a print job, the printing including discharging a charged photoreceptor of the printing device with light, the discharging leaving a residual voltage upon the photoreceptor;

during the printing, receiving an interrupt to trigger a null cycle;

in response to the interrupt, reducing a print blanket bias voltage, utilizing a controller, from a print bias level to a null bias level that is below a corona breakdown threshold voltage but above the residual voltage;

stopping the printing during the null cycle;

detecting that the interrupt has stopped;

in response to detecting that the interrupt has stopped, changing the print blanket bias voltage from the null bias level back to the print bias level; and inserting a print cycle into the print job following the null cycle.

2. A method as in claim 1, wherein stopping the printing comprises:

discontinuing writing images on the photoreceptor of the printing device; and halting transportation of print media within the printing device.

3. A method as in claim 1, wherein reducing the print blanket bias voltage comprises adjusting a voltage set-point of a voltage source coupled to the print blanket.

4. A method as in claim 1, wherein the interrupt is received from a printing subsystem indicating the printing subsystem is not ready to continue printing.

5. A method as in claim 1, further comprising:

during the null cycle, receiving a-null cycle trigger; and in response to the null cycle trigger, continuing to apply a null cycle voltage to the print blanket; and continuing to stop the printing.

6. A printing device comprising:

a photoreceptor to, after being charged, be discharged with light, wherein the discharging is to leave a residual voltage upon the photoreceptor, a print blanket to receive an ink image from the photoreceptor;

a bias unit to set a bias voltage of the print blanket;

a voltage source to provide a print bias voltage and a null cycle bias voltage; and a controller to:

detect an interrupt for a print job being printed by the printing device;

responsive to the interrupt, adjust a set-point of the bias unit from the print bias voltage to the null cycle bias voltage, wherein the null cycle bias voltage comprises a voltage value between the print blanket and the photoreceptor that is below a corona breakdown threshold voltage but is above the residual voltage;

detect that the interrupt has stopped;

in response to detecting that the interrupt has stopped, adjust the set-point of the bias unit back to the print bias voltage; and insert a print cycle into the print job.

7. A printing device as in claim 6, further comprising a printing subsystem to generate the interrupt when the printing subsystem senses it is not ready to perform a print cycle.

8. A non-transitory machine-readable storage medium storing instructions that when executed by a processor of a printing device, cause the printing device to:

during a print cycle of a printing process, discharge a charged photoreceptor of the printing device with light, the discharging leaving a residual voltage upon the photoreceptor;

detect an interrupt from a printing subsystem;

in response to detecting the interrupt, direct a bias unit to change a print blanket bias voltage from a print bias level to a null bias level that is below a corona breakdown threshold voltage but above the residual voltage; and insert a first null cycle into the printing process following the print cycle, wherein printing stops during the null cycle;

insert an additional null cycle following the first null cycle for each null cycle in which the detection of the interrupt persists; and maintain the print blanket bias voltage at the null bias level during each null cycle.

9. A non-transitory machine-readable storage medium as in claim 8, the instructions further causing the printing device to:

detect that the interrupt has stopped;

in response to detecting that the interrupt has stopped, change the print blanket bias voltage from the null bias level back to the print bias level; and insert a print cycle into the printing process following the null cycle.

10. A non-transitory machine-readable storage medium as in claim 9, wherein detecting that the interrupt has stopped occurs during a last null cycle in a series of null cycles that begins with the first null cycle.

11. A non-transitory machine-readable storage medium as in claim 10, wherein the last null cycle comprises the first null cycle.

12. A method as in claim 1, further comprising:

applying a print blanket bias voltage to the print blanket utilizing a plurality of slip rings to enable a stationary power supply unit of the printing device to electrify the print blanket.

13. A printing device as in claim 6, further comprising a plurality of slips rings to apply the print bias voltage to the print blanket to enable a stationary power supply unit of the printing device to electrify the print blanket.

14. A non-transitory machine-readable storage medium as in claim 8, the instructions further causing the printing device to:

apply a print blanket bias voltage to the print blanket utilizing a plurality of slip rings to enable a stationary power supply unit of the printing device to electrify the print blanket.

15. The method of claim 1, wherein the discharging of the charged photoreceptor with light is a selective discharging to form a latent image upon the photoreceptor.

* * * * *